United States Patent [19]

Barats et al.

[11] 4,139,991

[45] Feb. 20, 1979

[54] GAS CONDITIONER

[76] Inventors: Jury M. Barats, ulitsa Postysheva, 107, kv. 1; Valentin A. Selin, ulitsa 50-letia SSSR, 159, kv. 36; Jury N. Kiklevich, ulitsa Universitetskaya, 97, kv. 26; Vladimir M. Osyka, ulitsa Budenovskikh Partizan, 77, kv. 18; Nikolai A. Shmatkov, prospekt Grinkevicha, 2, kv. 36, all of Donetsk, U.S.S.R.

[21] Appl. No.: 817,116

[22] Filed: Jul. 18, 1977

[51] Int. Cl.[2] ..... F25B 9/00; F25D 9/00

[52] U.S. Cl. ..... 62/6; 62/403

[58] Field of Search ..... 62/5, 6, 259, 403

[56] References Cited

U.S. PATENT DOCUMENTS

| | | | |
|---|---|---|---|
| 932,946 | 8/1909 | Barkdoll | 62/403 |
| 2,545,861 | 3/1951 | Sallou | 62/403 |
| 3,074,244 | 1/1963 | Malaker et al. | 62/6 |
| 3,968,659 | 7/1976 | Pilcher | 62/5 |

*Primary Examiner*—Lloyd L. King

*Attorney, Agent, or Firm*—Haseltine, Lake & Waters

[57] ABSTRACT

The gas conditioner comprises a cooling device including a pulsing tube and switching means for alternatingly connecting said tube to a source of compressed gas and to a consumer. The switching means comprises a double-diaphragm pneumatic relay having a control chamber, an inlet chamber and an outlet chamber. The inlet chamber communicates with the source of compressed gas, and the outlet chamber communicates both with the pulsing tube and alternatingly with the inlet chamber and with the consumer, the outlet chamber communicating with the inlet chamber via a hollow rod overlapped when the pressure in the control chamber approximates that in the inlet chamber. A gate is mounted at the outlet of the outlet chamber, which opens upon the closing of the hollow rod to establish communication between this last-mentioned chamber and a line for supplying cooled gas from the outlet chamber to the consumer.

6 Claims, 2 Drawing Figures

GAS CONDITIONER

BACKGROUND OF INVENTION

The present invention relates to gas conditioners and is particularly intended for individual protection of man in hazardous environment, e.g. working under the conditions of elevated temperatures, for instance, for creating a microclimate in the under-clothing space of protective clothing.

The present invention can be used to utmost effectiveness by mine workers in deep mines, by operators wearing protective clothing in radioactive and chemically aggressive environments, by foundry workers, by aircraft personnel, etc. The invention is implementable both in a portable device and in a stationary modification, e.g. for installation in driver's or pilot cabs of vehicles and aircraft, in operator's cabs, etc.

There are known gas conditioners intended for protection of human being from thermal action of the environment, by supplying cooled gas under the protective clothing of an operator subjected to an elevated temperature.

A conditioner of this type comprises a source of compressed gas, or else a line for supplying compressed gas to the conditioner, a cooling device and regulating valves and taps for presetting a required temperature duty. Besides, there is incorporated a heat exchanger for precooling the compressed gas fed to the conditioner by means of an individual source of cold.

As the source of cold the aforementioned known conditioners employ a vortex tube of which the action is based on the phenomenon of energy-wise separation of a flow of gas introduced tangentially onto the internal wall of the tube, into two components having the temperatures, respectively, lower and higher than the temperature of the gas being introduced.

However, the hitherto known conditioners of the aforementioned type are not free from disadvantages of which the most serious ones will be discussed hereinbelow.

The vortex tube has been found to perform effectively at a certain speed of the vortex flow; therefore, there is a necessity of incorporating means for stabilizing the pressure of the gas supply. With the flow resistance of the consumer varying, the operating duty of the vortex tube likewise varies, which more often than not affects its efficiency factor.

Adjustment of the characteristics of the microclimate under the protective clothing is complicated at variation of the operating duty of the vortex tube, since at variations of the ratio of the flow rates of the "hot" and "cold" flows their respective temperatures vary, too. Moreover, the efficiency of the operation of the vortex tube is greatly dependent on the geometry, dimensions, shape and surface finish of its main components and of its main flow passage. The sophisticated character of the geometric shapes and the high requirements put before the surface finish raise the cost of manufacture of the gas conditioner, as the whole.

Furthermore, one should not underestimate the fact that in the hitherto known conditioners of the aforementioned type there are no provisions for adjusting the relative humidity, whereas with the gas cooled down to temperatures at which it is fed to the consumer, i.e. to the human being, the relative humidity of the gas may rise to as high as 100%, and droplets may fall out, which either precludes or at least hampers evaporation of sweat and affects the cooling ability of the gas.

OBJECTS OF INVENTION

It is an object of the present invention to improve the efficiency of a gas conditioner having a simple structure providing for a highly reliable performance.

It is another object of the invention to provide for a possibility of adjusting the temperature of the gas being outlet from the conditioner to the consumer.

It is still another object of the present invention to improve the characteristics of the conditioned gas by significantly reducing the moisture content thereof.

BRIEF SUMMARY OF INVENTION

These and other objects are attained in a gas conditioner comprising a cooling device adapted to be connected to a source of compressed gas and to a line for supplying conditioned gas to a point of utilization, to a consumer, in which conditioner, in accordance with the present invention, the cooling device includes a pulsing tube and a switching means for alternatingly communicating this tube with the source of compressed gas and with the consumer, the switching means being made in the form of a double-diaphragm pneumatic relay having an inlet chamber communicating with the source of compressed gas, a control chamber and an outlet chamber communicating with the control chamber via the pulsing tube and with the outlet chamber via a hollow rod overlapped upon the pressure within the control chamber approximating that within the inlet chamber, a gate being mounted at the outlet of the outlet chamber, adapted to open at the closing of the hollow rod, to establish communication between the last-mentioned chamber and the line for supplying cooled gas from the outlet chamber to the consumer.

Owing to the combination of the pulsing tube and the switching means made in the form of the double-diaphragm relay, the herein disclosed structure eliminates the "hot" component, which steps up the efficiency of the gas conditioner; moreover, it is worth pointing out that the efficiency of the conditioner is further enhanced owing to the fact that the incorporation of the switching means prevents mixing of the streams of the cooled and feed gas. Another advantage is that means for stabilizing the pressure of compressed gas supplied to the conditioner are no longer required.

It is expedient to have the switching means wherein the hollow rod should have an open end extending into the outlet chamber to a spacing from the gate, corresponding to the stroke of the rod upon a variation of the pressure within the control chamber, so that with the pressure within the control chamber approximating the pressure within the inlet chamber, the end of the rod should bear upon the gate, urging the latter to open to establish communication between the outlet chamber and the line for supplying cooled gas to the consumer, while breaking off the communication between the inlet chamber and the outlet chamber.

With the switching means having this structure, it is possible to do without lapped-in movable parts and their individual actuators.

Further improvement of the characteristics of the gas supplied to the consumer can be attained by reducing the relative humidity of the gas, by providing a moisture separator at the outlet of the outlet chamber, separated from this chamber by said gate.

According to one of the embodiments of the present invention, the moisture separator communicates with the consumer via two parallel lines with a control valve mounted in each line, the lines communicating with sealed away heat insulation chambers, one chamber receiving the pulsing tube in the form of a heat exchanger and the other chamber accommodating a regenerative heat exchanger communicating with the source of the compressed gas and with the inlet chamber of the pneumatic relay, the respective outlets of the two sealed away chambers being interconnected by the common line communicating with the consumer.

The abovedescribed structure of the gas conditioner enables to control the temperature characteristics of the conditioned gas.

It is also expedient, in order improve the operating conditions of the herein disclosed gas conditioner, that the heated portion of the pulsing tube should be situated to face one of the walls of the moisture separator and should include radiation plates separated with heat-insulation gaskets, the spacing pitch of these plates gradually decreasing in the direction of the advance of the gas entering the tube, the said one wall of the moisture separator having mounted therein nozzles facing the radiation plates, to throw thereupon the liquid condensed in the moisture separator.

BRIEF DESCRIPTION OF DRAWINGS

The present invention will be further described in connection with embodiments thereof in a gas conditioner, with reference being had to the appended drawings, wherein.

Figure 1:
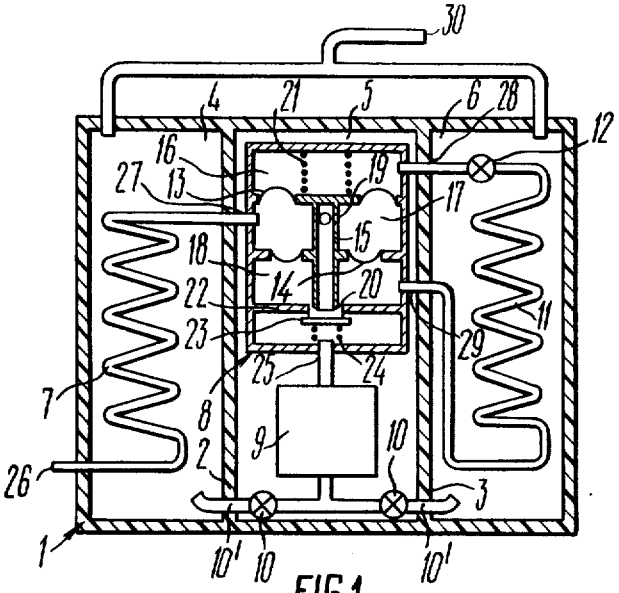
FIG. 1 illustrates a gas conditioner embodying the invention.

Referring now to the appended drawings, the gas conditioner includes a housing 1 made of a heat insulation material and divided by partitions 2 and 3 into three sealed chambers 4, 5 and 6. The chamber 4 accommodates a regenerative heat exchanger 7 schematically illustrated as a coil. The heat exchanger 7 being considered the regenerative or utilization one since it cools down the gas supplied to the conditioner from the source of the compressed gas by the cold generated by the conditioner itself, which will be described in more detail below.

The chamber 5 accommodates therein a switching means 8, a moisture separator 9 and control valves 10. The chamber 6 includes a pulsing tube 11 made in the form of a heat exchanger schematically illustrated as a coil, associated with a throttle valve 12.

The switching means 8 is made in the form of a double-diaphragm pneumatic relay. It includes diaphragms 13 and 14 having their outer margins fixed in the housing of the pneumatic relay and their inner margins fixed to the rod 15 of this relay. The effective area of the diaphragm 13 is somewhat greater than that of the diaphragm 14.

The diaphragms 13 and 14 subdivide the internal space of the switching means 8 into three chambers, viz. the control one 16, the inlet one 17 and the outlet one 18. The rod 15 is a hollow one and has apertures 19 communicating its internal space with the inlet chamber 17, as well as an open end 20 extending into the outlet chamber 18.

Received in the control chamber 16 is a compression spring 21 urging the rod 15. The spring is such made that the pressure of the compressed gas in the inlet chamber 17 is able to displace the rod 15 by acting thereupon through the diaphragm 13 and compressing the spring 21.

The outlet of the pneumatic relay is defined by a nozzle 22 overlapped with a gate 23 urged against the nozzle into the nozzle-closing position by a compression spring 24. The last-mentioned spring is arranged so that the pressure of the compressed gas within the outlet chamber 18 should not be able to drive the gate 23 by itself to clear the nozzle 22. The gate 23 can clear the nozzle 22 under the action thereupon of the rod 15, and in this case the gate 23 closes off the open end 20 of the rod.

The outlet nozzle 22 of the pneumatic relay communicates via a passage 25 with the inlet of a moisture separator 9 of any suitable known structure. The outlet of the separator 9 communicates via control valve 10 mounted in two respective lines 10', running parallel to each other, with the sealed chambers 4 and 6 of the housing 1 of the gas conditioner.

The regenerative heat exchanger 7 communicates via a line 26 with the source of the compressed gas, and via a line 27 with the inlet chamber 17 of the pneumatic relay. A line 28 connects the throttling valve 12 mounted at the end of the pulsing tube 11 with the control chamber 16. The other end of the pulsing tube 11 is connected via a line 29 with the outlet chamber 18. The sealed chambers 4 and 6 are connected in parallel with the consumer via a delivery line 30. The herein disclosed gas conditioner can be enclosed within a case (not shown) that can be carried by a worker.

The gas conditioner operates, as follows.

Compressed gas supplied from a compressed gas source or mains (not shown), or else from an individual receiver or from a cylinder (not shown, either) flows via the line 26 into the regenerative heat exchanger 7, passes therethrough and through the line 17, and fills the inlet chamber of the switching means 8. The pressure in the inlet chamber 17 is built up. The effective area of the diaphragm 13 being greater than that of the diaphragm 14, the resulting force acting upon the rod 15 as the joint action of the diaphragms 13 and 14 moves the rod 15 in the direction toward the control chamber 16, and the spring 21 is compressed. The open end 20 of the rod 15 clears the gate 23, and the compressed gas from the inlet chamber 17 flows via the apertures 19 in the wall of the hollow rod 15 and through the open end 20 of the latter, to fill the outlet chamber 18. The increasing pressure of the compressed gas in the outlet chamber 18 acts upon the diaphragm 14, whereby the rod 15 is driven still further toward the control chamber 16. The compressed gas flows via the line 29 and fills the pulsing tube 11, wherefrom it flows via the throttling valve 12 and the line 28 into the control chamber 16. With the pressure of the compressed gas in the control chamber 16 having been built up to a certain value, the force acting onto the rod 15 from the diaphragm 13 becomes weaker than the effort exerted thereupon by the compressed spring 21. Under this action of the spring 21 the rod 15 is driven in the direction of the outlet chamber, its open end 20 engaging the gate 23. Thus, the open end 20 is closed, breaking off the communication between the inlet chamber 17 and the outlet chamber 18. Meanwhile, the pressure in the control chamber 16 is being built up, owing to the access of the gas from the pulsing tube 11. The rod 15 urges the gate 23 with an increasing effort, and when the pressure within the control chamber 16 is built up to a value approximating the pressure within the inlet chamber 17, the rod 15 drives the gate 23 clear of the nozzle 22. The moment the gate 23 is thus opened, the pressure in the outlet chamber 18 drops, whereby there is created an additional effort acting from the diaphragm 14 onto the rod 15. The rod, therefore, acts upon the gate 23 with an even greater effort, driving it further away from the nozzle 22, whereby there is established communication between the outlet chamber 18 and the line 25, and through this line — with the moisture separator 9. The pressure in the pulsing tube 11 drops rapidly, and the compressed gas starts flowing from the control chamber 16 via the line 28 and the throttle valve 12 into the pulsing tube 11, and therefrom via the line 29 into the outlet chamber 18.

Then the abovedescribed operation repeats itself, and the double-diaphragm pneumatic valve operates in the self-induced oscillating mode, alternatingly connecting the pulsing tube 11 with the source of the compressed gas and with the consumer. In this way the pulsing tube 11 is alternatingly filled with and emptied of the gas. In accordance with the Joule law, the temperature of the gas varies with the pulsing tube 11 being filled and emptied. When the pulsing tube 11 is being filled, the temperature of the gas being compressed therein rises. The relatively great surface of the pulsing tube 11 which in the preferred embodiment is in the form of a heat exchanger enables to dissipate some of the heat evolving at the compression of the gas into the space of the sealed chamber 6, whereby the final temperature of the gas compressed in the pulsing tube 11 is somewhat lowered. With the gas leaving the pulsing tube 11 expanding, its temperature lowers and becomes lower than the temperature of the gas coming from the compressed gas source.

With the gas cooling down, condensation of the water vapors takes place, the droplets of the moisture being retained in the moisture separator 9 and, in the course of their accumulation, are withdrawn from the herein described gas conditioner via apertures of the moisture separator 9 and housing 1 (not shown in FIG. 1).

The cooled and dried gas passes through the sealed chamber 6 and is somewhat heated by the heat dissipated by the pulsing tube 11, the relative humidity of the gas thus lowering.

In the sealed chamber 4 the temperature of the gas leaving the moisture separator 9 is likewise somewhat raised by heat transfer from the gas flowing from the compressed gas source and passing through the regenerative heat exchanger 7. In this way the compressed gas entering the inlet chamber 17 is somewhat cooled down, which has been found to increase the efficiency factor of the conditioner.

By adjusting by means of the control valves 10 the ratio of the gas flows through the chambers 4 and 6, respectively, it is possible to attain the required characteristics of the gas supplied to the consumer via the line 30.

The flow rate of the cooled gas and, consequently, the cold output of the gas conditioner can be adjusted by varying the frequency of the cycling of the pneumatic switching means 8, i.e. of the pneumatic relay, by adjusting the throttling valve 12.

Figure 2:
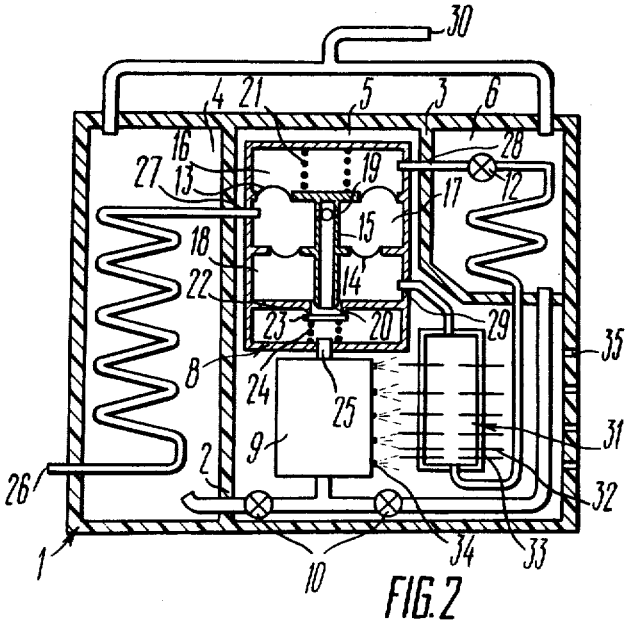
FIG. 2 illustrates a gas conditioner basically similar to that shown in FIG. 1, but offering improved conditions of the operation of the pulsing tube.

Illustrated in FIG. 2 of the appended drawings is a modification of the above described embodiment of the gas conditioner, wherein the moisture condensed in the moisture separator is utilized to cool additionally the heated portion of the pulsing tube. It is obvious to those skilled in the art that as a result of the alternating compression and expansion of the gas in the pulsing tube, its temperature is distributed non-uniformly and increases in the direction of the flow of the gas entering the pulsing tube. Owing to the relatively high thermal conductivity of the material of the pulsing tube, there takes place certain levelling out of the temperature of the gas within the pulsing tube, which affects the efficiency of the gas conditioner. Therefore, the modified structure of the conditioner, illustrated in FIG. 2, enables to cool down the heated portion of the pulsing tube more effectively, by evaporating therefrom the condensed moisture, and thus to attain more uniform heat transfer from the heated portion of the pulsing tube, to minimize the levelling out of the gas temperature within the pulsing tube, and thus to step up the efficiency factor of the gas conditioner, as a whole.

The aforementioned modification of the gas conditioner is basically similar to the embodiment illustrated in FIG. 1; therefore, like positions are indicated in the two drawings with like numerals. The difference therebetween resides in that the portion of the pulsing tube 11 indicated in FIG. 2 with numeral 31 and shown on a larger scale extends into the chamber 5 of the gas conditioner and is provided with an array of radiation plates 32 separated from one another by heat insulation gaskets 33. The radiation plates 32 are spaced at a pitch decreasing in the direction of the flow of the gas entering the pulsing tube 11. One of the walls of the moisture separator 9 is provided with nozzles 34 facing the radiation plates 32. The wall of the chamber 5 of the gas conditioner has made therethrough a series of apertures 35 connecting this chamber 5 with ambient atmosphere.

In operation of the gas conditioner, which has been already described hereinabove, the moisture condensed in the moisture separator 9 is thrown by the certain gauge pressure of the cooled and expanded gas onto the radiation plates 32 of the heated portion 31 of the pulsing tube 11 and is evaporated therefrom. The vapor-gas mixture accummulating in the chamber 5 leaves for ambient atmosphere through the apertures 35. The provision of the heat insulation gaskets 33 minimizes transfer of heat from more heated radiation plates 32 to less heated ones. In every other respect the operation of the modification of the gas conditioner, illustrated in FIG. 2, is similar to that of the embodiment described hereinabove in connection with FIG. 1.

The herein disclosed gas conditioner provides optimum characteristics of the conditioned gas or air (with reduced relative humidity of the gas) and offers adjustability of these characteristics of the conditioned gas. The herein disclosed gas conditioner has a simple and reliable structure operable within a wide range of the temperatures of the supplied compressed gas.

What is claimed is:

1. A gas conditioner, comprising in combination a pulsing tube alternatingly connectable with a source of compressed gas and with a consumer of conditioned gas, the compressed gas coming from said source having a relatively high temperature, this gas upon leaving said pulsing tube at connection thereof with the consumer having a substantially lower temperature, a switching means adapted to connect said pulsing tube alternatingly with said source of the compressed gas and with the consumer, including a double-diaphragm pneumatic relay having an inlet chamber, an outlet chamber and a control chamber, said inlet chamber communicating with said source of the compressed gas, and said outlet chamber communicating with said control chamber via said pulsing tube and with said inlet chamber via a hollow rod being overlapped upon the pressure within said control chamber approximating the pressure within said inlet chamber, and a gate mounted at the outlet of said outlet chamber and adapted to be opened upon the closing of the hollow rod, to establish communication between said outlet chamber with a line for supplying the cooled gas from said outlet chamber to the consumer.

2. A gas conditioner as set forth in claim 1, wherein said control chamber communicates with said pulsing tube via a throttling valve.

3. A gas conditioner as set forth in claim 1, wherein the hollow rod has an open end extending into said outlet chamber, to a spacing from the gate, corresponding to the stroke of this rod upon the variation of the pressure within said control chamber, so that upon the pressure within said control chamber approximating the pressure within said inlet chamber the said end of the rod engages the said gate, urging the latter to open and thus to establish communication between said outlet chamber and the line for supplying the cooled gas to the consumer, while breaking off the communication between said inlet chamber and said outlet chamber.

4. A gas conditioner as set forth in claim 1, wherein a moisture separator is provided at the outlet of said outlet chamber, separated from this last-mentioned chamber by said gate.

5. A gas conditioner as set forth in claim 4, wherein said moisture separator is connected to the consumer via two parallel lines with control valve means in each line, the said two lines communicating with two sealed heat-insulation chambers of which one accommodates said pulsing tube in the form of a heat exchanger and the other one accommodates a regenerative heat exchanger connected to said source of the compressed gas and to said inlet chamber of said pneumatic relay, the outlets of these sealed chambers being interconnected by a common line connected to the consumer.

6. A gas conditioner as set forth in claim 1, wherein the heated portion of said pulsing tube is situated to face one of the walls of the moisture separator and has spaced radiation plates separated by heat insulation gaskets, the spacing pitch of these radiation plates gradually decreasing in the direction of the flow of the gas entering said pulsing tube, said one wall of the moisture separator having mounted therein nozzles facing these radiation plates, to throw thereupon the liquid condensed in the moisture separator.

* * * * *